United States Patent [19]

Santoni

[11] 4,314,720

[45] Feb. 9, 1982

[54] SPLIT RING LOCKING ASSEMBLY

[75] Inventor: Cesar Santoni, Hamilton, Canada

[73] Assignee: Greif Bros. Corporation, Delaware County, Ohio

[21] Appl. No.: 85,262

[22] Filed: Oct. 16, 1979

[51] Int. Cl.[3] ..... E05C 19/08

[52] U.S. Cl. ..... 292/256.69

[58] Field of Search ..... 292/256.69, 256.5; 220/320, 321

[56] References Cited

U.S. PATENT DOCUMENTS

| | | | |
|---|---|---|---|
| 1,903,010 | 3/1933 | Rolloson | 292/256.69 |
| 2,245,532 | 6/1941 | Severy | 292/256.69 X |
| 2,493,204 | 1/1950 | Mauer | 292/256.65 X |
| 2,707,123 | 4/1955 | Shults | 292/256.69 |
| 2,884,176 | 4/1959 | Carpenter et al. | 292/256.69 X |
| 2,905,496 | 9/1959 | Hornsby | 292/256.69 |
| 3,339,961 | 9/1967 | Schaefer | 292/256.69 |

*Primary Examiner*—Richard E. Moore

*Attorney, Agent, or Firm*—Kane, Dalsimer, Kane, Sullivan & Kurucz

[57] ABSTRACT

A split ring locking rim assembly for releasably securing a head or cover to a container having a split ring with two ends positioned substantially adjacent to one another with a raised part of eyelet thereon space from one end of the ring to receive a portion of a locking mechanism. The locking mechanism includes a lever shaped so as to align the ring during operation which is pivotally connected to one end of the ring with the other end of the ring pivotally connected to a connecting link which is pivotally connected to the lever. The lever includes a tongue with a raised portion thereon in the form of an eyelet and in operation the lever serves to bring the ring ends together sealing the cover or head to the container while the lever tongue enters the receptacle on the ring with the raised portion on the tongue passing therethrough wherein this raised portion acts as a retaining means for the lever in its closed position while also providing a means for securing a sealing wire.

20 Claims, 5 Drawing Figures

4
4
13
14
22
12
22
14
62
38
42
26
24
54
30
56
32
28
50
52
60
28

13
62
22
12
17
20
18
62
22
16
14
44
48
38
15
42

22
14
38
48
22
14
22

SPLIT RING LOCKING ASSEMBLY

FIELD OF THE INVENTION

This invention relates to improvements in a split ring locking rim and more particularly a locking rim for clamping the cover or head of a container.

BACKGROUND OF THE INVENTION

There exists a wide variety of split ring locking rims commercially available which generally include horizontal or vertical, lever-operated closing members which are swung in a plane parallel or vertical to that of the top drum rim or clamping ring, on a fiber or steel drum or container. Representative of these are U.S. Pat. Nos. 3,768,848, granted Oct. 30, 1973 and 2,905,496 granted Sept. 22, 1959. This clamping ring may be located about the top outer edge of the drum securing the top cover to the container. In the case where a recessed opening is desired in the top cover, there exists a limited space between the outside edge of the opening and the inside edge of the top rim or outer edge of the drum. While in the former case any present vertical or horizontal clamping ring can be installed on the top opening, in the latter situation, leveraging of the clamping ring is inhibited by its spacing from the outer top rim and horizontal surface of the top itself. This is since the clamping ring is located in the well formed by the outer top rim of the drum, horizontal surface of the top cover and the usually beaded edge of the top opening. Heretofore, the top covers of recessed opening were secured by a nut and bolt closure means, which was time-consuming and awkward due to the space limitations as aforementioned.

Usually a sealing wire is placed on the locking rim once it is secured to the container to insure that the contents and integrity of the container may be maintained during shipping or storage at least with respect to possible access via the container cover. This sealing wire inhibits pilfering and allows the ultimate receiver of the container to be assured that the contents are the same upon receipt, as that when shipped. Once the sealing wire is removed it is often desirous that the locking rim be readily removable and of a reusable nature, allowing for the cover of the container to be removed and then securely fastened to the container by the locking rim assembly when so desired.

Also, it is desirous that the locking rim be economical and have a minimum number of parts. Further, its operation should be simple, and capable of fastening the cover to the container through a single levering action which may be accomplished by untrained personnel.

In addition, the device should provide a receptacle for the sealing wire to be readily placed there on when so desired without a tortured installation for said wire.

SUMMARY OF THE INVENTION

Accordingly, it is an object of the invention to provide for a locking rim for a container top including containers where the top opening is recessed which has a minimum number of parts and is simply and effectively operated in the limited space provided.

It is another object to provide for a means of securing a sealing ring on the locking ring simply and effectively, in such a manner that effective locking is not dependent upon the use of the sealing wire.

These advantages are provided by the present arrangement for a split ring locking rim assembly. The locking rim is provided with a split locking ring for releasably securing a head or cover to a container. The split ring is provided with a receptacle or eyelet thereon spaced from one end of the ring to receive a portion of the locking mechanism. The locking mechanism includes a lever which is pivotally connected to the one end of the ring with the other end of the ring pivotally connected to the connecting link which is pivotally connected to the lever. The lever is shaped so that a portion of it engages the horizontal surface of the top of the container and presses thereagainst during closing and opening of the ring. The lever includes a tongue with a raised portion thereon in the form of an eyelet. In operation, the lever serves to bring the ring ends together, when pivoted in a downward perpendicular direction to that of the locking ring, with that portion of the lever engaging the horizontal surface of the top providing a cam action which aligns the ring ends so as to properly engage the usually beaded opening and the cover. The lever tongue enters the receptacle on the ring with the raised portion on the tongue passing therethrough. This eyelet acts as a retaining means for the lever in its now closed position while also having an opening therethrough to provide a receptacle for a sealing wire, thereby serving two functions in one structure.

Other objects and advantages will become apparent from the following detailed description which is to be taken in conjunction with the accompanying drawings illustrating the somewhat preferred embodiment of the invention.

DETAILED DESCRIPTION OF THE DRAWINGS

Figure 1:
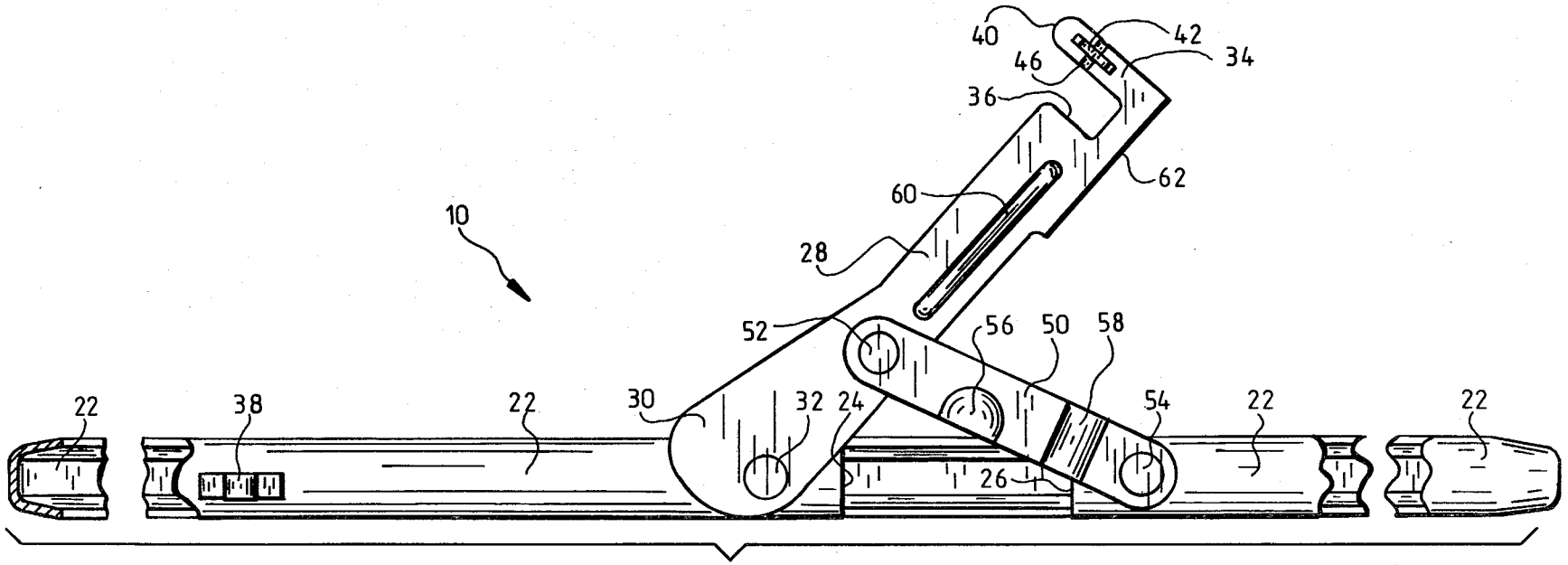
FIG. 1 is a partially sectional and fragmentary view of the split ring locking rim in an open position ready to be placed on the head or cover of a container.

In the form of the invention illustrated in FIGS. 1 through 5, the split ring locking rim 10 serves to releasably close a metal or otherwise fabricated cover 12 on an opening in the top cover 13 of a container or drum. In the case of a recessed top opening, as shown, the typical construction of the top cover 13 would include a horizontal plane surface 14, terminating at an inner peripheral wall 15 mounted adjacent to the container wall on one side, and on the opposite side at a radial wall 16 of the opening. An annular bead 17 would be located about the wall 16 and is usually integral therewith and formed therefrom. This arrangement allows the opening to be incorporated in a recessed fashion on the top cover 13.

The cover 12 is usually fitted with a rounded flange portion 18 which is seated on the annular bead 17 with an intermediate sealant 20 located therebetween. Of course, if so desired, rather than a sealant, a portion of a blown lining of the container may be used in its place.

Referring now to the split ring locking rim 10, a split ring 22 having a U-shaped transversal cross-section is made of a suitable resilient metal such as steel and is provided with a locking mechanism connected between the ends 24 and 26 whereby the ring may be expanded to permit its assembly around the cover 12 and the container and contracted to tightly engage the assembled cover and container in holding the cover in place over the top of the drum in a manner well known in the art.

In the locking mechanism illustrated in the drawings, a locking lever 28 is pivotally hinged at its base end 30 to the end 24 of the locking ring 22 by means of a pin 32. Of course, any manner of affixing the base end 30 of the locking lever 28 to the end of the ring 22 may be utilized as long as said connection allows for pivotal rotation of the lever with respect to the ring. The base end 30 of the locking lever 28 is shaped so that at a point in operation it presses against surface 14 of the top cover 13, providing a cam action on the end 24 of the locking ring, lifting it up and aligning it with the flange 18 and bead 17. Without it, the end 24 might be pressed below said members during closing.

Figure 2:
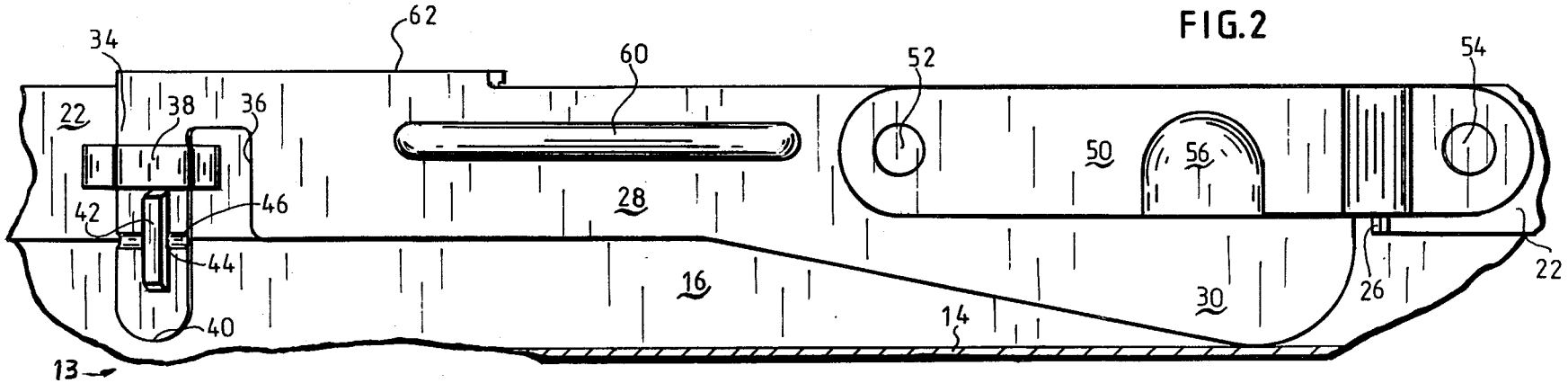
FIG. 2 is a perspective view of the split ring locking rim assembly in its closed position on a container.

Also, the locking lever 28 is somewhat elongated and slightly arcuated having at its end opposite to that of base 30 a tongue 34. Adjacent the tongue is a notch 36 partially defining the tongue so as to allow engagement of the tongue with a raised portion or eyelet 38 located upon the split ring 22 when the locking mechanism is in its closed position as shown in FIG. 2.

The tongue 34 has a rounded edge at 40 so as to facilitate its passing through eyelet 38. Also located on the tongue is a raised portion thereon in the form of an eyelet 42 to which the eye 44 of the eyelet has on its adjacent sides a scored portion 46 which is parallel to the lever and facilitates the passing therethrough of a sealing wire (not shown) when the locking mechanism is in its closed position; when the raised portion 42 has passed through the eyelet 38 of the split ring 22. This advantageously allows for the installation of a sealing wire parallel to the lever rather than at right angles thereto, which is often the case in other type closure and which would be awkward where the opening is recessed.

Figure 5:
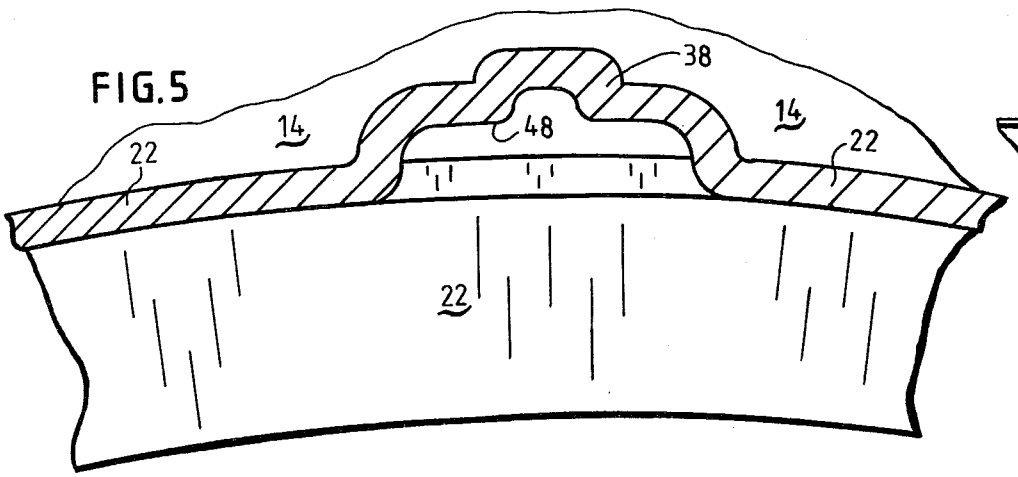
FIG. 5 is a plan view of the eyelet portion of the split ring locking rim located on said rim.

As shown in FIG. 5, the eyelet 38 on the split ring 22 is formed with an internal surface 48 somewhat corresponding to the shape of the tongue 34 and raised portion 42 thereon. Once the tongue 34 is disposed fully in the eyelet 38, the raised portion 42 abuts the eyelet 38, thereby effectively maintaining the locking mechanism in its closed position without the necessity of a sealing wire.

Returning now to the lever 28, it is also pivotally connected at an intermediate point between its base and the end where the tongue is located, to a connecting link 50 by way of a pin 52. The connecting link 50 is pivotally connected at its other end by way of a pin 54 to the end 26 of the split ring 22. As in the case of pin 32, the pins 52 and 54 may be riveted or fastened in any other manner desired so long as they allow rotation of the appropriate locking mechanism element during operation. The connecting link 50 is provided with a semicircular beveled portion 56 which allows the connecting link to fit over the pin 32 when the locking mechanism is in its closed position as is shown most clearly in FIG. 3.

Figure 3:
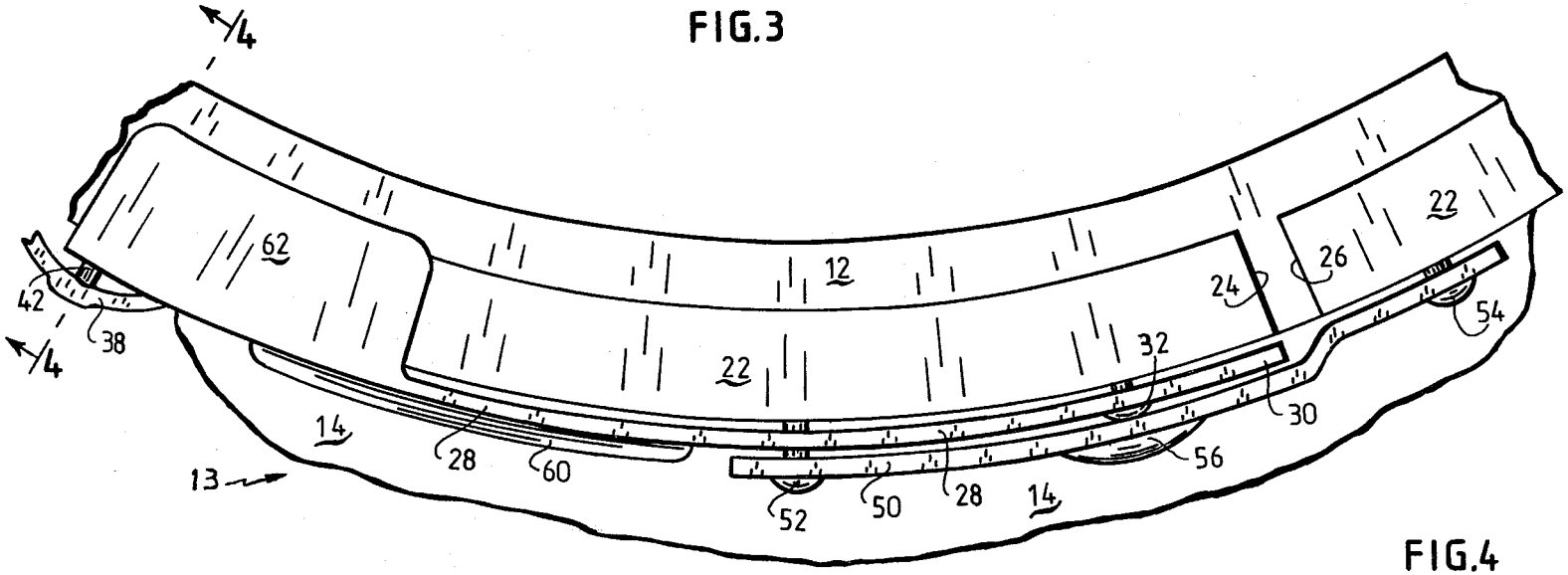
FIG. 3 is a plan view of the assembly while in its closed position as shown in FIG. 2 located on a container.

With regard now particularly to FIG. 3, there is shown a plan view of the device in its closed position. Since the split ring locking rim assembly is illustrated as being used on a circular opening in the top of a container, the elements of the locking mechanism, that being the locking lever 28 and the connecting link 50 are slightly arcuated to conform to the angular shape of the lock ring 22 and container. The connecting link 50 is formed so as to have a portion at 58 which angles out so as to allow the connecting link to slide over that portion of the lever between pin 52 and the levers base end 30 when the locking mechanism is in its closed position.

The lever 28 is also provided with a longitudinal rib 60 which serves to strengthen the lever while providing an abutment surface between said rib and said connecting link so as to provide a convenient means of indicating when the locking rim has been opened sufficiently, allowing its removal along with the cover from the container. In addition, the lever 28 is provided with a flat portion 62 located near the tongue end of said lever to effectuate a closing or opening of a locking mechanism by way of a vertical force thereon.

Figure 4:
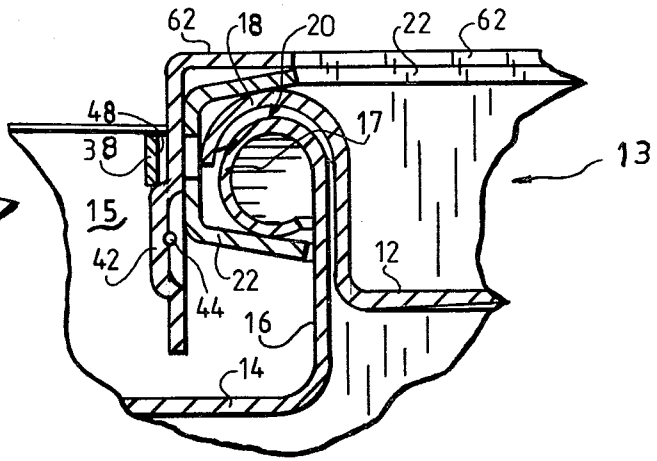
FIG. 4 is a vertical sectional view taken on lines 4—4 of FIG. 3.

As is readily seen in FIG. 4, the eyelet 42 of the lever 28 and the eyelet 38 located on the rim 22 may readily be press formed out of the material comprising the lever and ring without additional material being added thereto. This provides a rather simple and economical way of forming said elements.

In operation, when the split ring locking assembly is in place about the flange of the cover and the bead of the top cover as shown in FIG. 3, a closing of the device is provided by application of a force on the lever 28, preferably on the portion 62 of the lever, which moves the lever from the position as shown in FIG. 1 to that as shown in FIG. 2. During the change in position, the connecting link 50 and the lever 28 serve to bring the ring ends 24 and 26 together to a point when pins 52 and 54 are aligned as shown in FIG. 2. As aforementioned, the base end 30 by pressing against surface 14 serves to cam the ring end 24 into alignment with the flange 18 and annular bead 17. The tongue 34 passes through the eyelet 38 until the raised portion thereon 42 has completely passed through said eyelet. As it is evident, the tongue portion is sufficiently long to accomplish this prior to the time the surface 62 abuts the locking ring 22. As aforementioned, at this time a sealing wire may be placed horizontally through the eye 44 of the eyelet or raised portion 42 thereby sealing the container from an unauthorized opening.

While the ring ends 24 and 26 are being brought together and aligned during the closing the locking mechanism, the diameter of the locking rim 22 is decreasing with the result that the flange 18 of the cover 12 and the bead 17 of the top cover 13 are being cammed together thereby effectively sealing the cover and the container against leakage.

Once the sealing wire is removed, the locking mechanism may be brought to the open position as shown in FIG. 1 by means of a force exerted on the lever 28, conveniently by the surface 62 provided therefrom, in a direction upwardly with respect to the locking ring 22. During this movement, the raised portion 42 of the tongue 34 passes through the eyelet 38 and once clear thereof, allows the device to be expanded to its open position.

The device, when it is in its closed position, advantageously prevents unwanted opening of the device due to the interaction of the raised portion 42 and the eyelet 38 without the necessity of a sealing wire. This effectively allows the device to be used with or without a sealing wire, after the initial authorized opening.

In addition, the device provides for effective sealing of a cover to a container through the use of relatively few parts by a lever having a portion which serves to align the ring ends, and a portion which acts as a receptacle for a sealing wire while also providing a means which prevents accidental or unwanted opening of the device during transit or storage. Thus the aforenoted objects and advantages are most effectively obtained and although a somewhat preferred embodiment of the invention has been disclosed and described in detail herein, it should be understood that this invention is in no sense limited thereby and its scope is to be determined by that of the appended claims.

What is claimed is:

1. A locking rim assembly for use in releasably holding a cover in an assembled relationship with a container comprising: a split ring having two ends positioned substantially adjacent to one other; a locking lever having a base end which is pivotally connected to one end of the split ring; a connecting link pivotally connected at one of its ends to the split ring and at its other end pivotally connected to the locking lever; the pivotal connections being so constructed and arranged so that the locking lever is shiftable from an open position at which the split ring is in an expanded position to a closed position at which the split ring is in a contracted position; said locking lever having at its end opposite to that which connects directly with the split ring a tongue; said tongue having a receiving means capable of receiving a sealing wire; a receptacle located on said split ring for the tongue when the locking lever is in its closed position; wherein when said locking lever shifts from its open to its closed position said tongue and receiving means pass through said receptacle so that a sealing wire may be secured to said receiving means to inhibit unauthorized opening of the locking rim assembly.

2. A locking rim assembly for use in releasably holding a cover in an assembled relationship with a container comprising: a split ring having two ends positioned substantially adjacent to one other; a locking lever having a base end which is pivotally connected to one end of the split ring; a connecting link pivotally connected at one of its ends to the split ring and at its other end pivotally connected to the locking lever; the pivotal connections being so constructed and arranged so that the locking lever is shiftable from an open position at which the split ring is in an expanded position to a closed position at which the split ring is in a contracted position; and means pivotally engageable with a container so as to provide for alignment of the ends of the split ring and a cover when said lever is shifted from its open to its closed position.

3. The invention in accordance with claim 2 which includes a cover and a container having an outer edge wherein the cover is releasably held over an opening in the container which is axially recessed from the container's outer edge.

4. The invention in accordance with claim 3 wherein said means includes forming said locking lever at its base end so that it pivotally engages a horizontal surface disposed between the outer edge and opening of the container when said lever is shifted from its open to its closed position causing alignment of the ends of the split ring and the cover by a camming action.

5. The invention in accordance with claim 1 which includes a cover and a container having an outer edge wherein the cover is releasably held over an opening in the container which is axially recessed from the container's outer edge.

6. The invention in accordance with claim 5 wherein said locking lever is shaped at its base end so that it pivotally engages a horizontal surface disposed between the outer edge and the opening of the container when said lever is shifted from its open to its closed position causing alignment of the ends of the split ring and the cover by a camming action.

7. The invention in accordance with claim 1 or 6 wherein said receiving means is a raised portion located on said tongue.

8. The invention in accordance with claim 7 wherein when said locking lever is in its closed position said raised portion serves to abut said receptacle thereby preventing unwanted shifting of said locking lever from its closed to its open position while said raised portion also provides for a means of securing a sealing wire to said locking rim assembly.

9. The invention in accordance with claim 1 or 2 wherein the split ring has a U-shaped transverse cross-section which is adapted to engage a flange of a cover to a container when said locking lever is in its closed position.

10. The invention in accordance with claim 7 wherein the receptacle on the split ring for receiving the tongue and raised portion thereon of the locking lever is an eyelet, wherein when said locking lever is in its closed position a portion of said eyelet is disposed in a notched portion of said locking lever and said eyelet has an interior surface which conforms to the exterior surface of the tongue and raised portion thereon so that said surfaces slidably interact when said locking lever shifts between its open and its closed position.

11. The invention in accordance with claim 1 or 6 wherein the locking lever has a surface adjacent the tongue and perpendicular thereto providing a convenient means to apply an opening or closing force on said locking lever.

12. The invention in accordance with claim 11 wherein the locking lever is in its fully closed position when said surface abuts the split ring.

13. The invention in accordance with claim 7 wherein the raised portion on the tongue is in the form of an eyelet having a hole therethrough to receive the sealing wire.

14. The invention in accordance with claim 1 or 2 wherein the locking lever is provided with a longitudinal rib which serves to strengthen said lever while providing an abutment surface for said connecting link when said locking lever in its open position.

15. The invention in accordance with claim 1 or 2 wherein said pivotal connections consist of riveted pins.

16. The invention in accordance with claim 1 or 6 wherein the tongue has a rounded end which initially engages said receptacle when said locking lever moves from its open to its closed position thereby facilitating the sliding arrangement as between the receptacle and said tongue during said movement of the locking lever.

17. The invention in accordance with claim 6 wherein said locking lever is integrally constructed with said tongue and raised portion thereon with said lever being made of a metallic material.

18. The invention in accordance with claim 6 wherein said receptacle and said raised portion on said tongue are pressed formed integrally out of said split ring and said tongue respectively.

19. The invention in accordance with claim 12 wherein said tongue is scored across its surface horizontally with respect to the lever adjacent to said hole in said raised portion to facilitate insertion of the sealing wire therethrough.

20. The invention in accordance with claim 1 or 2 wherein the connecting link has a portion which angles outward relative to the split ring so as to allow said connecting link to slidably engage the surface of the locking lever with a portion of said connecting link beveled so as to allow the connecting pin which pivotally connects one end of a locking lever to one end of the split ring, to slide thereunder when the locking lever shifts between its open and closed position.

* * * * *